US005820701A

United States Patent [19]

Bhargava

[11] Patent Number: 5,820,701

[45] Date of Patent: Oct. 13, 1998

[54] COPPER ALLOY AND PROCESS FOR OBTAINING SAME

[75] Inventor: Ashok K. Bhargava, Cheshire, Conn.

[73] Assignee: Waterbury Rolling Mills, Inc., Waterbury, Conn.

[21] Appl. No.: 780,116

[22] Filed: Dec. 26, 1996

Related U.S. Application Data

[63] Continuation-in-part of Ser. No. 747,014, Nov. 7, 1996.

[51] Int. Cl.[6] ..... C22C 9/02

[52] U.S. Cl. ..... 148/433; 420/472

[58] Field of Search ..... 420/469, 472; 148/433

[56] References Cited

U.S. PATENT DOCUMENTS

| | | | |
|---|---|---|---|
| 2,062,427 | 12/1936 | Pierson | 75/157 |
| 3,923,558 | 12/1975 | Shapiro et al. | 75/153 |
| 4,586,967 | 5/1986 | Shapiro et al. | 148/412 |
| 4,605,532 | 8/1986 | Knorr et al. | 420/472 |
| 4,627,960 | 12/1986 | Nakajima et al. | 420/472 |
| 4,666,667 | 5/1987 | Kamio et al. | 420/471 |
| 4,822,562 | 4/1989 | Miyafuji et al. | 420/472 |
| 5,487,867 | 1/1996 | Singh | 420/471 |

FOREIGN PATENT DOCUMENTS

| | | |
|---|---|---|
| 57-002849 | 1/1982 | Japan . |
| 60-245754 | 12/1985 | Japan . |
| 63-192834 | 8/1988 | Japan . |
| 03006341 | 1/1991 | Japan . |
| 3002341 | 1/1991 | Japan . |
| 3087341 | 4/1991 | Japan . |
| 04088138 | 3/1992 | Japan . |
| 6073474 | 3/1994 | Japan . |
| 6220594 | 8/1994 | Japan . |
| 1726547 | 4/1992 | U.S.S.R. . |

*Primary Examiner*—Sikyin Ip
*Attorney, Agent, or Firm*—Bachman & LaPointe, P.C.

[57] ABSTRACT

A copper base alloy consisting essentially of tin in an amount from about 1.0 to 11.0% by weight, phosphorous in an amount from about 0.01 to 0.35% by weight, iron in an amount from about 0.01 to about 0.8% by weight, and the balance essentially copper, including phosphide particles uniformly distributed throughout the matrix, is described. The alloy is characterized by an excellent combination of physical properties. The process of forming the copper base alloy described herein includes casting, homogenizing, rolling, process annealing and stress relief annealing.

14 Claims, No Drawings

COPPER ALLOY AND PROCESS FOR OBTAINING SAME

CROSS-REFERENCE TO RELATED APPLICATION(S)

The present application is a continuation-in-part application of U.S. patent application Ser. No. 08/747,014, filed Nov. 7, 1996, entitled COPPER ALLOY AND PROCESS FOR OBTAINING SAME.

BACKGROUND OF THE INVENTION

The present invention relates to copper base alloys having utility in electrical applications and to a process for producing said copper base alloys.

There are a number of copper base alloys that are used in connector, lead frame and other electrical applications because their special properties are well suited for these applications. Despite the existence of these alloys, there remains a need for copper base alloys that can be used in applications that require high yield strength in the order of 80 to 150 KSI, together with good forming properties that allow one to make 180° badway bends with a R/T ratio of 1 or less plus low relaxation of stress at elevated temperatures and freedom of stress corrosion cracking. Alloys presently available do not meet all of these requirements or have high costs that make them less economical in the marketplace or have other significant drawbacks. It remains highly desirable to develop a copper base alloy satisfying the foregoing goals.

Beryllium copper generally has very high strength and conductivity along with good stress relaxation characteristics; however, these materials are limited in their forming ability. One such limitation is the difficulty with 180° badway bends. In addition, they are very expensive and often require extra heat treatment after preparation of a desired part. Naturally, this adds even further to the cost.

Phosphor bronze materials are inexpensive alloys with good strength and excellent forming properties. They are widely used in the electronic and telecommunications industries. However, they tend to be undesirable where they are required to conduct very high current under very high temperature conditions, for example under conditions found in automotive applications for use under the hood. This combined with their high thermal stress relaxation rate makes these materials less suitable for many applications.

High copper, high conductivity alloys also have many desirable properties, but generally do not have mechanical strength desired for numerous applications. Typical ones of these alloys include, but are not limited to, copper alloys 110, 122, 192 and 194.

Representative prior art patents include U.S. Pat. Nos. 4,666,667, 4,627,960, 2,062,427, 4,605,532, 4,586,967, and 4,822,562.

Accordingly, it is highly desirable to develop copper base alloys having a combination of desirable properties making them eminently suitable for many applications.

SUMMARY OF THE INVENTION

In accordance with the present invention, it has been found that the foregoing objective is readily obtained.

Copper base alloys in accordance with the present invention consist essentially of tin in an amount from about 1.0 to 11.0%, phosphorous in an amount from about 0.01 to 0.35%, preferably from about 0.01% to 0.1%, iron in an amount from about 0.01% to 0.8%, preferably from about 0.05% to 0.25%, and the balance essentially copper. It is particularly advantageous to include nickel and/or cobalt in an amount up to about 0.5% each, preferably in an amount from 0.001% to about 0.5% each. Alloys in accordance with the present invention may also include zinc in an amount up to 0.3%, lead in an amount up to 0.05%, and up to 0.1% each of aluminum, silver, boron, beryllium, calcium, chromium, indium, lithium, magnesium, manganese, lead, silicon, antimony, titanium, and zirconium.

In yet another embodiment of the present invention, the copper base alloy may include zinc in an amount from about 9.0% to 15.0%.

It is desirable and advantageous in the alloys of the present invention to provide phosphide particles of iron and/or nickel and/or magnesium or a combination thereof, uniformly distributed throughout the matrix since these particles serve to increase strength, conductivity, and stress relaxation characteristics of the alloys. The phosphide particles may have a particle size of 50 Angstroms to about 0.5 microns and may include a finer component and a coarser component. The finer component may have a particle size ranging from about 50 to 250 Angstroms, preferably from about 50 to 200 Angstroms. The coarser component may have a particle size generally from 0.075 to 0.5 microns, preferably from 0.075 to 0.125 microns.

Percentage ranges throughout this application are percentages by weight.

The alloys of the present invention enjoy a variety of excellent properties making them eminently suitable for use as connectors, lead frames, springs and other electrical applications. The alloys should have an excellent and unusual combination of mechanical strength, formability, thermal and electrical conductivities, and stress relaxation properties.

The process of the present invention comprises: casting a copper base alloy having a composition as aforesaid; homogenizing at least once for at least two hours at temperatures from about 1000° to 1450° F.; rolling to finish gauge including at least one process anneal for at least one hour at 650° to 1200° F.; and stress relief annealing for at least one hour at a temperature in the range of 300° to 600° F., thereby obtaining a copper alloy including phosphide particles uniformly distributed throughout the matrix. Nickel and/or cobalt may be included in the alloy as above.

DETAILED DESCRIPTION OF THE PREFERRED EMBODIMENT(S)

The alloys of the present invention are modified phosphor bronze alloys. They are characterized by higher strengths, better forming properties, higher conductivity, and stress relaxation properties that represent a significant improvement over the same properties of unmodified phosphor bronzes.

Modified phosphor bronze alloys in accordance with the present invention include those copper base alloys consisting essentially of tin in an amount from about 1.5 to 11%, phosphorous in an amount from about 0.01 to 0.35%, preferably from about 0.01 to 0.1%, iron in an amount from about 0.01 to 0.8%, preferably from about 0.05 to 0.25%, and the balance essentially copper. These alloys typically will have phosphide particles uniformly distributed throughout the matrix.

These alloys may also include nickel and/or cobalt in an amount up to about 0.5% each, preferably from about 0.001 to 0.5% of one or combinations of both, zinc in an amount up to about 0.3% max, and lead in an amount up to about 0.05% max.

One may include one or more of the following elements in the alloy combination: aluminum, silver, boron, beryllium, calcium, chromium, indium, lithium, magnesium, manganese, lead, silicon, antimony, titanium, and zirconium. These materials may be included in amounts less than 0.1%, each generally in excess of 0.001 each. The use of one or more of these materials improves the mechanical properties such as stress relaxation properties; however, larger amounts may affect conductivity and forming properties.

The aforesaid phosphorous addition allows the metal to stay deoxidized making it possible to cast sound metal within the limits set for phosphorous, and with thermal treatment of the alloys, phosphorous forms a phosphide with iron and/or iron and nickel and/or iron and magnesium and/or a combination of these elements, if present, which significantly reduces the loss in conductivity that would result if these materials were entirely in solid solution in the matrix. It is particularly desirable to provide iron phosphide particles uniformly distributed throughout the matrix as these help improve the stress relaxation properties by blocking dislocation movement.

Iron in the range of 0.01 to 0.8% and particularly 0.05 to 0.25% increases the strength of the alloys, promotes a fine grain structure by acting as a grain growth inhibitor and in combination with phosphorous in this range helps improve the stress relaxation properties without negative effect on electrical and thermal conductivities.

Nickel and/or cobalt in an amount from about 0.001 to 0.5% each are desirable additives since they improve stress relaxation properties and strength by refining the grain and through distribution throughout the matrix, with a positive effect on the conductivity.

The process of the present invention includes casting an alloy having a composition as aforesaid. Any suitable casting technique known in the art such as horizontal continuous casting may be used to form a strip having a thickness in the range of from about 0.500 to 0.750 inches. The processing includes at least one homogenization for at least two hours, and preferably for a time period in the range of from about 2 to about 24 hours, at temperatures in the range of from about 1000° to 1450° F. At least one homogenization step may be conducted after a rolling step. After homogenization, the strip may be milled once or twice to remove from about 0.020 to 0.100 inches of material from each face.

The material is then rolled to final gauge, including at least one process anneal at 650° to 1200° F. for at least one hour and preferably for about 1 to 24 hours, followed by slow cooling to ambient at 20° to 200° F. per hour.

The material is then stress relief annealed at final gauge at a temperature in the range of 300° to 600° F. for at least one hour and preferably for a time period in the range of about 1 to 20 hours. This advantageously improves formability and stress relaxation properties.

The thermal treatments advantageously and most desirably provide the alloys of the present invention with phosphide particles of iron and/or nickel and/or magnesium or a combination thereof uniformly distributed throughout the matrix. The phosphide particles increase the strength, conductivity, and stress relaxation characteristics of the alloys. The phosphide particles may have a particle size of about 50 Angstroms to about 0.5 microns and may include a finer component and a coarser component. The finer component may have a particle size of about 50 to 250 Angstroms, preferably from about 50 to 200 Angstroms. The coarser component may have a particle size generally from 0.075 to 0.5 microns, preferably from 0.075 to 0.125 microns.

Alloys formed in accordance with the process of the present invention and having the aforesaid compositions are capable of achieving an electrical conductivity of from about 12 to 35% IACS. The foregoing coupled with the desired metallurgical structure should give the alloys a high stress retention ability, for example over 60% at 150° C., after 1000 hours with a stress equal to 75% of its yield strength on samples cut parallel to the direction of rolling, makes these alloys very suitable for a wide variety of applications requiring high stress retention capabilities. Moreover, the present alloys do not require further treatment by stampers.

The alloys of the present invention may be tailored to provide a desired set of properties by varying the tin content of the alloys while maintaining the other constituents within the aforesaid ranges and processing the alloy in the manner described above. The following table demonstrates the properties which may obtained for different tin contents.

TABLE I

| No. | Tin Content (wt %) | Tensile Strength (ksi) | Yield Strength 0.2% Offset (ksi) |
|---|---|---|---|
| 1 | 9–11 | 130–150 | 125–145 |
| 2 | 7–9 | 120–140 | 115–135 |
| 3 | 5–7 | 110–130 | 105–125 |
| 4 | 3–5 | 100–120 | 95–115 |
| 5 | 1.5–3 | 90–110 | 85–105 |

Alloys in accordance with the present invention are also capable of achieving a very desirable set of mechanical and forming properties, also by varying the tin content of the alloy while maintaining the other constituents within the aforesaid ranges and processing the alloy as described above. The following table illustrates the types of properties which may be achieved.

TABLE II

| Tin (wt %) | Tensile Strength (ksi) | Yield Strength 0.2% Offset (Ksi) | Elongation % | Badway 180° Bend Width To Thickness Ratio of up to 10:1 |
|---|---|---|---|---|
| 7–9 | 110–130 | 105–125 | 5–10 | Radius to Thickness Ratio = 1 |
| 5–7 | 100–120 | 96–116 | 5–10 | Radius to Thickness Ratio = 1 |
| 3–5 | 92–112 | 88–108 | 5–10 | Radius to Thickness Ratio = 1 |
| 1.5–3 | 85–105 | 80–100 | 5–10 | Radius to Thickness Ratio = 1 |

As can be seen from the foregoing tables, alloys in accordance with the present invention not only have higher strengths, but also have particularly desirable combinations of strength and formability. The properties are such that the alloys of the present invention can replace alloys like beryllium coppers and copper alloys with nickel silicon, e.g. CDA 7025 and 7026, in many applications. This is particularly useful to connector manufacturers since the alloys of the present invention cost less than the alloys which they can replace.

Yet another embodiment of a modified phosphor bronze in accordance with the present invention comprises a copper base alloy consisting essentially of tin in an amount from about 1.0 to 4.0%, zinc in an amount from about 9.0 to 15.0%, phosphorous in an amount from about 0.01 to 0.2%, iron in an amount from about 0.01 to 0.8%, nickel and/or cobalt in an amount from about 0.001 to 0.5%, and the balance essentially copper.

The aforesaid phosphorous addition allows the metal to stay deoxidized making it possible to cast sound metal within the limits set for phosphorous, and with thermal treatment of the alloy, phosphorous forms a phosphide with iron and/or iron and nickel and/or iron and magnesium or a combination of these elements, if present, which significantly reduces the loss in conductivity that would result if these materials were entirely in solid solution in the matrix. It is particularly desirable to provide iron phosphide particles uniformly distributed throughout the matrix as these help improve the stress relaxation properties by blocking dislocation movement.

Iron in the range of 0.01 to 0.8% increases the strength of the alloys, promotes a fine grain structure by acting as a grain growth inhibitor and in combination with phosphorous in this range helps improve the stress relaxation properties without negative effect on electrical and thermal conductivities.

Zinc in an amount from 9.0 to 15.0% helps deoxidize the metal, helping the castings to be sound without use of excessive phosphorous that can hurt conductivities. Zinc also helps in keeping the metal oxide free for good adhesion in plating and increases strength.

Nickel and/or cobalt in an amount from about 0.001 to 0.5% each are desirable additives since they improve stress relaxation properties and strength by refining the grain and through distribution throughout the matrix, with a positive effect on the conductivity.

One may include one or more of the following elements in the alloy combination: aluminum, silver, boron, beryllium, calcium, chromium, cobalt, indium, lithium, magnesium, manganese, zirconium, lead, silicon, antimony, and titanium. These materials may be included in amounts less than 0.1% each generally in excess of 0.001 each. The use of one or more of these materials improves the mechanical properties such as stress relaxation properties; however, larger amounts may effect conductivity and forming properties.

This alternative alloy may be processed using the technique described hereinbefore. Using such a technique, the alloy is capable of achieving the following properties: a tensile strength in the range of 90 to 105 ksi, a yield strength at 0.2% offset in the range of 85 to 100 ksi, elongation in the range of 5 to 10%, and bend properties for a 180° badway bend (width:thickness ratio up to 10:1) of radius: thickness ratio equal to 1. The alloy is also characterized by the presence of the aforementioned desirable phosphide particles uniformly distributed throughout the matrix.

This invention may be embodied in other forms or carried out in other ways without departing from the spirit or essential characteristics thereof. The present embodiments are therefore to be considered as in all respects illustrative and not restrictive, the scope of the invention being indicated by the appended claims, and all changes which come within the meaning and range of equivalency are intended to be embraced therein.

What is claimed is:

1. A copper base alloy consisting of tin in an amount from about 1.0 to 11.0% by weight, phosphorous in an amount from about 0.01 to 0.35% by weight, iron in an amount from about 0.01 to about 0.8% by weight, and the balance copper, said alloy including phosphide particles uniformly distributed throughout the matrix, said phosphide particles having a finer component with a particle size in the range of from about 50 Angstroms to about 250 Angstroms and a coarser component with a particle size in the range of from about 0.075 microns to about 0.5 microns for improving the stress relaxation properties of said alloy.

2. A copper base alloy according to claim 1, wherein said tin content is from 1.5 to 11.0% by weight.

3. A copper base alloy according to claim 2, wherein said phosphorous content is from 0.01 to 0.10% by weight.

4. A copper base alloy according to claim 2, wherein said iron content is from 0.05 to 0.25% by weight.

5. A copper base alloy according to claim 1, wherein said tin content is from 5.0 to 7.0% by weight.

6. A copper base alloy according to claim 1, wherein said tin content is from 3.0 to 5.0% by weight.

7. A copper base alloy according to claim 1, wherein said tin content is from 7.0 to 9.0% by weight.

8. The alloy of claim 1 wherein said alloy has no phosphide particles having a size greater than 0.5 microns.

9. A copper base alloy according to claim 1, wherein said tin content is from 1.5 to 3.0% by weight.

10. A copper base alloy according to claim 1, wherein said tin content is from 9.0 to 11.0% by weight.

11. A copper base alloy consisting of tin in an amount from 1.0 to 4.0% by weight, zinc in an amount from 9.0 to 15.0% by weight, phosphorous in an amount from 0.01 to 0.2% by weight, iron in an amount from 0.01 to 0.8% by weight, a material selected from the group consisting of nickel, cobalt, and mixtures thereof in an amount from 0.001 to 0.5% by weight each, and the balance essentially copper, said alloy including phosphide particles uniformly distributed throughout the matrix, said phosphide particles having a minimum particle size of about 50 Angstroms and a maximum particle size of about 0.5 microns for improving the stress relaxation properties of the alloy.

12. The alloy of claim 11 wherein said alloy has no phosphide particles having a size greater than 0.5 microns.

13. A copper base alloy consisting of tin in an amount from 1.0 to 11.0% by weight, phosphorous in an amount from 0.01 to 0.35% by weight, iron in an amount from about 0.01 to 0.8% by weight, a material selected from the group consisting of nickel, cobalt and mixtures thereof in an amount from about 0.001 to 0.5% by weight each, magnesium in an amount up to 0.1% by weight, zinc in an amount up to about 0.3% by weight, lead in an amount up to about 0.05% by weight, and the balance copper, said alloy including phosphide particles uniformly distributed throughout the matrix, said phosphide particles being selected from the group consisting of iron nickel phosphide particles, iron magnesium phosphide particles, iron phosphide particles, magnesium nickel phosphide particles, magnesium phosphide particles and mixtures thereof, said phosphide particles having a finer component with a particle size in the range of from about 50 Angstroms to about 250 Angstroms and a coarser component with a particle size in the range of from about 0.075 microns to about 0.5 microns.

14. A copper base alloy consisting of tin in an amount from about 1.0 to 11.0% by weight, phosphorous in an amount from about 0.01 to 0.35% by weight, iron in an amount from about 0.01 to about 0.8% by weight, a material selected from the group consisting of nickel, cobalt and mixtures thereof in an amount from about 0.001 to 0.5% by weight each, at least one addition selected from the group consisting of aluminum, silver, boron, beryllium, calcium, chromium, indium, lithium, magnesium, manganese, lead, silicon, antimony, titanium, and zirconium, said at least one addition being present in an amount up to 0.1% each, and the balance copper, said alloy including phosphide particles uniformly distributed throughout the matrix, said phosphide particles being selected from the group consisting of iron nickel phosphide particles, iron magnesium phosphide particles, iron phosphide particles, magnesium nickel phosphide particles, magnesium phosphide particles and mixtures thereof, said phosphide particles having a finer component with a particle size in the range of from about 50 Angstroms to about 250 Angstroms and a coarser component with a particle size in the range of from about 0.075 microns to about 0.5 microns.

* * * * *

UNITED STATES PATENT AND TRADEMARK OFFICE

CERTIFICATE OF CORRECTION

PATENT NO. : 5,820,701

DATED : October 13, 1998

INVENTOR(S) : Bhargava

It is certified that error appears in the above-identified patent and that said Letters Patent is hereby corrected as shown below:

Column 4, line 17, between "may" and "obtained", --be--. Should be inserted; and
Column 6, claim 11, line 32, "essentially" should be deleted.

Signed and Sealed this

Twenty-second Day of June, 1999

*Attest:*

Q. TODD DICKINSON

*Attesting Officer*

*Acting Commissioner of Patents and Trademarks*